US009638034B2

(12) United States Patent
Chen et al.

(10) Patent No.: US 9,638,034 B2
(45) Date of Patent: May 2, 2017

(54) APPARATUS AND METHOD FOR PULSE TESTING A FORMATION

(75) Inventors: Dingding Chen, Tomball, TX (US); Mark A. Proett, Houston, TX (US); Christopher Michael Jones, Houston, TX (US); Abdolhamid Hadibeik, Austin, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 178 days.

(21) Appl. No.: 14/403,079

(22) PCT Filed: Jun. 13, 2012

(86) PCT No.: PCT/US2012/042238

§ 371 (c)(1),
(2), (4) Date: Jan. 27, 2015

(87) PCT Pub. No.: WO2013/187890

PCT Pub. Date: Dec. 19, 2013

(65) Prior Publication Data

US 2015/0176403 A1 Jun. 25, 2015

(51) Int. Cl.
*E21B 49/00* (2006.01)
*E21B 47/06* (2012.01)

(52) U.S. Cl.
CPC ..... *E21B 49/008* (2013.01); *E21B 47/06* (2013.01)

(58) Field of Classification Search
CPC ..... E21B 47/06; E21B 49/008; E21B 21/08; E21B 49/00; E21B 47/00; E21B 2049/085; G01V 99/005
(Continued)

(56) References Cited

U.S. PATENT DOCUMENTS 4,523,459 A * 6/1985 Hastings ..... E21B 47/10 166/271
5,233,866 A 8/1993 Desbrandes
(Continued)

FOREIGN PATENT DOCUMENTS

WO 2011044070 4/2011

OTHER PUBLICATIONS

International Search Report of PCT Application No. PCT/US2012/042238 dated Feb. 19, 2013: pp. 1-3.
(Continued)

*Primary Examiner* — Daniel S Larkin
*Assistant Examiner* — Anthony W Megna Fuentes
(74) *Attorney, Agent, or Firm* — Chamberlain Hrdlicka

(57) ABSTRACT

A system for pressure testing a formation includes a downhole tool configured to measure formation pressure, storage containing pressure parameters of a plurality of simulated formation pressure tests, and a formation pressure test controller coupled to the downhole tool and the storage. For each of a plurality of sequential pressure testing stages of a formation pressure test, the formation pressure test controller 1) retrieves formation pressure measurements from the downhole tool; 2) identifies one of the plurality of simulated formation pressure tests comprising pressure parameters closest to corresponding formation pressure values derived from the formation pressure measurements; and 3) determines a flow rate to apply by the downhole tool in a next stage of the test based on the identified one of the plurality of simulated formation pressure tests.

28 Claims, 13 Drawing Sheets

(58) Field of Classification Search
USPC ..... 73/152.01–152.62
See application file for complete search history.

(56) References Cited

U.S. PATENT DOCUMENTS

| | | | | |
|---|---|---|---|---|
| 5,501,273 | A * | 3/1996 | Puri | E21B 49/008 166/245 |
| 6,672,386 | B2 | 1/2004 | Krueger et al. | |
| 6,871,713 | B2 | 3/2005 | Meister et al. | |
| 6,923,052 | B2 | 8/2005 | Krueger et al. | |
| 7,011,155 | B2 | 3/2006 | Meister et al. | |
| 7,031,841 | B2 | 4/2006 | Zazovsky et al. | |
| 7,263,880 | B2 | 9/2007 | Pop et al. | |
| 7,290,443 | B2 | 11/2007 | Follini et al. | |
| 2003/0182061 | A1 | 9/2003 | Ferworn et al. | |
| 2006/0293857 | A1* | 12/2006 | Moos | E21B 43/00 702/12 |
| 2009/0000785 | A1 | 1/2009 | Zhan et al. | |
| 2009/0165548 | A1 | 7/2009 | Pop et al. | |
| 2009/0204328 | A1 | 8/2009 | Stewart | |
| 2009/0283265 | A1 | 11/2009 | Maxit et al. | |
| 2010/0116494 | A1 | 5/2010 | Fox et al. | |
| 2010/0286918 | A1* | 11/2010 | Moos | E21B 43/25 702/12 |
| 2011/0130966 | A1 | 6/2011 | Zhan et al. | |
| 2011/0251796 | A1 | 10/2011 | Waid et al. | |
| 2011/0272147 | A1 | 11/2011 | Beasley et al. | |
| 2012/0043078 | A1 | 2/2012 | Ziauddin et al. | |
| 2012/0055242 | A1 | 3/2012 | Tustin et al. | |
| 2012/0316788 | A1* | 12/2012 | Bedouet | E21B 21/08 702/12 |
| 2015/0040657 | A1 | 2/2015 | Proett et al. | |

OTHER PUBLICATIONS

Meister et al., SPE 90425: "Pressure Gradient Testing with a New Formation Pressure Testing During Drilling Tool," SPE International, Sep. 2004: pp. 1-10.

* cited by examiner

1200

| | Pdd1 | Pbu1 | Pij1 | Pbd1 | Pdd2 | Pbu2 | Pij2 | Pbd2 | Pdd3 | Pbu3 | Pij3 | Pstb |
|---|---|---|---|---|---|---|---|---|---|---|---|---|
| 1). | 16496 | 16538 | 17392 | 17302 | 16603 | 16655 | 16850 | 16840 | 16704 | 16719 | 16801 | 16798 |
| 2). | 16610 | 16564 | 17419 | 17334 | 16774 | 16812 | 16937 | 16931 | 16878 | 16883 | 16900 | 16901 |
| 3). | 16505 | 16571 | 17428 | 17348 | 16907 | 16935 | 17020 | 17015 | 16986 | 16988 | 17000 | 16998 |
| 4). | 16521 | 16597 | 17455 | 17380 | 17039 | 17057 | 17115 | 17111 | 17088 | 17089 | 17101 | 17097 |
| 5). | 16516 | 16605 | 17464 | 17394 | 17133 | 17145 | 17383 | 17355 | 17135 | 17151 | 17200 | 17195 |
| 6). | 16494 | 16530 | 17408 | 17366 | 16717 | 16745 | 17084 | 17071 | 16914 | 16920 | 17000 | 16994 |
| 7). | 16498 | 16547 | 17417 | 17359 | 16733 | 16769 | 17086 | 17068 | 16976 | 16980 | 17000 | 16996 |
| 8). | 16517 | 16613 | 17445 | 17327 | 16821 | 16877 | 17114 | 17084 | 16901 | 16926 | 17001 | 16994 |
| 9). | 16531 | 16653 | 17457 | 17304 | 16898 | 16951 | 17115 | 17084 | 16921 | 16950 | 16999 | 16998 |
| 10). | 16501 | 16557 | 17422 | 17355 | 16840 | 16870 | 17109 | 17093 | 16961 | 16969 | 17001 | 16999 |
| 11). | 16503 | 16564 | 17425 | 17351 | 16699 | 16748 | 17250 | 17209 | 16855 | 16881 | 17001 | 16993 |
| 12). | 16506 | 16577 | 17431 | 17345 | 16812 | 16854 | 17015 | 17005 | 16951 | 16957 | 17000 | 16994 |
| 13). | 16508 | 16583 | 17433 | 17342 | 16851 | 16889 | 17074 | 17058 | 16959 | 16968 | 17006 | 17000 |
| 14). | 16401 | 16489 | 17444 | 17348 | 16740 | 16792 | 17059 | 17038 | 16979 | 16982 | 17000 | 16994 |
| 15). | 16456 | 16532 | 17435 | 17348 | 16851 | 16887 | 17067 | 17052 | 16973 | 16979 | 17000 | 16997 |
| 16). | 16549 | 16607 | 17422 | 17348 | 16809 | 16847 | 17074 | 17058 | 16967 | 16973 | 17001 | 16998 |
| 17). | 16589 | 16640 | 17417 | 17349 | 16861 | 16892 | 17048 | 17039 | 16978 | 16982 | 17001 | 16999 |
| 18). | 16333 | 16429 | 17453 | 17354 | 16941 | 16964 | 17064 | 17054 | 16980 | 16986 | 17002 | 16999 |
| 19). | 16438 | 16516 | 17449 | 17360 | 16806 | 16848 | 17057 | 17042 | 16984 | 16987 | 17003 | 16998 |
| 20). | 16581 | 16636 | 17428 | 17355 | 16879 | 16910 | 17015 | 17010 | 16978 | 16981 | 17004 | 17000 |
| 21). | 16629 | 16676 | 17412 | 17346 | 16873 | 16904 | 17073 | 17061 | 16964 | 16971 | 17000 | 16999 |

FIG. 13

1300

| | Pdd1 | Sbu1 | Pij1 | Sbd1 | Pdd2 | Sbu2 | Pij2 | Sbd2 | Pdd3 | Sbu3 | Pij3 | Pstb |
|---|---|---|---|---|---|---|---|---|---|---|---|---|
| 1). | 16496 | 0.9512 | 17392 | -2.0020 | 16603 | 1.1639 | 16850 | -0.2193 | 16704 | 0.3325 | 16801 | 16798 |
| 2). | 16510 | 1.1898 | 17419 | -1.9010 | 16774 | 0.8487 | 16937 | -0.1403 | 16878 | 0.1148 | 16900 | 16901 |
| 3). | 16505 | 1.4750 | 17428 | -1.7759 | 16907 | 0.6070 | 17020 | -0.1025 | 16986 | 0.0532 | 17000 | 16998 |
| 4). | 16521 | 1.6942 | 17455 | -1.6767 | 17039 | 0.4011 | 17115 | -0.0926 | 17088 | 0.0301 | 17101 | 17097 |
| 5). | 16516 | 1.9587 | 17464 | -1.5540 | 17133 | 0.2687 | 17383 | -0.6203 | 17135 | 0.3480 | 17200 | 17195 |
| 6). | 16494 | 0.8010 | 17408 | -0.9429 | 16717 | 0.6074 | 17084 | -0.2898 | 16914 | 0.1424 | 17000 | 16994 |
| 7). | 16498 | 1.0942 | 17417 | -1.3010 | 16733 | 0.8045 | 17085 | -0.3762 | 16976 | 0.0723 | 17000 | 16996 |
| 8). | 16517 | 2.1265 | 17445 | -2.6146 | 16821 | 1.2310 | 17114 | -0.6575 | 16901 | 0.5423 | 17001 | 16994 |
| 9). | 16531 | 2.7223 | 17457 | -3.4095 | 16898 | 1.1721 | 17115 | -0.6766 | 16921 | 0.6580 | 16999 | 16998 |
| 10). | 16501 | 1.2477 | 17422 | -1.4886 | 16840 | 0.6691 | 17109 | -0.3706 | 16961 | 0.1745 | 17001 | 16999 |
| 11). | 16503 | 1.3690 | 17425 | -1.6414 | 16699 | 1.0980 | 17250 | -0.9256 | 16855 | 0.5768 | 17001 | 16993 |
| 12). | 16506 | 1.5695 | 17431 | -1.8966 | 16812 | 0.9299 | 17015 | -0.2158 | 16951 | 0.1174 | 17000 | 16994 |
| 13). | 16508 | 1.6550 | 17433 | -2.0064 | 16851 | 0.8609 | 17074 | -0.3578 | 16959 | 0.1952 | 17006 | 17000 |
| 14). | 16401 | 1.9511 | 17444 | -2.1373 | 16740 | 1.1557 | 17059 | -0.4682 | 16979 | 0.0558 | 17000 | 16994 |
| 15). | 16456 | 1.6933 | 17435 | -1.9425 | 16851 | 0.7874 | 17067 | -0.3218 | 16973 | 0.1281 | 17000 | 16997 |
| 16). | 16549 | 1.2887 | 17422 | -1.6321 | 16809 | 0.8516 | 17074 | -0.3518 | 16967 | 0.1342 | 17001 | 16998 |
| 17). | 16589 | 1.1286 | 17417 | -1.5070 | 16861 | 0.6921 | 17048 | -0.2098 | 16978 | 0.1342 | 17001 | 16999 |
| 18). | 16333 | 2.1225 | 17453 | -2.2127 | 16941 | 0.5167 | 17064 | -0.2229 | 16980 | 0.1282 | 17002 | 16999 |
| 19). | 16438 | 1.7312 | 17449 | -1.9846 | 16806 | 0.9214 | 17057 | -0.3466 | 16984 | 0.0654 | 17003 | 16998 |
| 20). | 16581 | 1.2160 | 17428 | -1.6273 | 16879 | 0.6896 | 17015 | -0.1072 | 16978 | 0.0672 | 17004 | 17000 |
| 21). | 16629 | 1.0483 | 17412 | -1.4830 | 16873 | 0.6820 | 17073 | -0.2577 | 16964 | 0.1672 | 17000 | 16999 |

FIG. 14

1400

| | Qdd2/Qij1 | Qij2/Qdd2 | Qdd3/Qij2 | Qij3/Qdd3 |
|---|---|---|---|---|
| 1). | 0.8118 | 0.2753 | 0.7114 | 0.5922 |
| 2). | 0.6486 | 0.2220 | 0.4322 | 0.3098 |
| 3). | 0.5094 | 0.1918 | 0.3471 | 0.4106 |
| 4). | 0.3929 | 0.1706 | 0.3965 | 0.5306 |
| 5). | 0.3004 | 0.9310 | 0.9122 | 0.2220 |
| 6). | 0.7365 | 0.5231 | 0.4635 | 0.5075 |
| 7). | 0.7176 | 0.5043 | 0.2878 | 0.2220 |
| 8). | 0.6016 | 0.4698 | 0.7741 | 0.4039 |
| 9). | 0.4949 | 0.4102 | 1.0000 | 0.2878 |
| 10). | 0.5922 | 0.4667 | 0.5482 | 0.2408 |
| 11). | 0.7553 | 0.7710 | 0.7020 | 0.3349 |
| 12). | 0.6204 | 0.3004 | 0.3380 | 0.8024 |
| 13). | 0.5733 | 0.3757 | 0.5357 | 0.3820 |
| 14). | 0.6329 | 0.4384 | 0.2188 | 0.3129 |
| 15). | 0.5451 | 0.3631 | 0.4416 | 0.2690 |
| 16). | 0.6580 | 0.4196 | 0.4008 | 0.3067 |
| 17). | 0.6235 | 0.3192 | 0.3945 | 0.3098 |
| 18). | 0.4855 | 0.3035 | 0.7427 | 0.6518 |
| 19). | 0.5890 | 0.3788 | 0.2722 | 0.2753 |
| 20). | 0.5953 | 0.2188 | 0.3161 | 0.7208 |
| 21). | 0.6361 | 0.3569 | 0.5796 | 0.2910 |

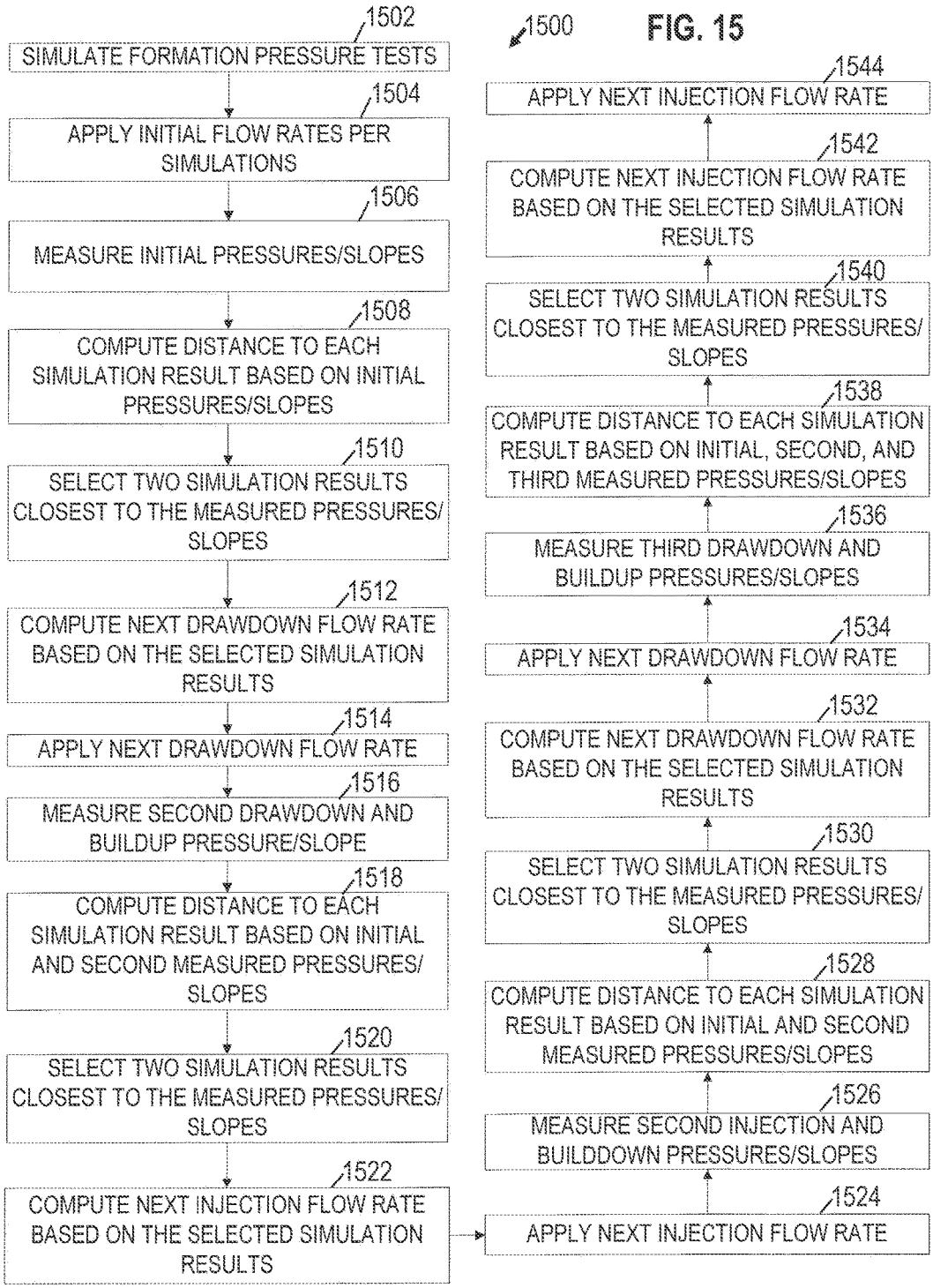
1500
FIG. 15
1502
SIMULATE FORMATION PRESSURE TESTS
1504
APPLY INITIAL FLOW RATES PER SIMULATIONS
1506
MEASURE INITIAL PRESSURES/SLOPES
1508
COMPUTE DISTANCE TO EACH SIMULATION RESULT BASED ON INITIAL PRESSURES/SLOPES
1510
SELECT TWO SIMULATION RESULTS CLOSEST TO THE MEASURED PRESSURES/ SLOPES
1512
COMPUTE NEXT DRAWDOWN FLOW RATE BASED ON THE SELECTED SIMULATION RESULTS
1514
APPLY NEXT DRAWDOWN FLOW RATE
1516
MEASURE SECOND DRAWDOWN AND BUILDUP PRESSURE/SLOPE
1518
COMPUTE DISTANCE TO EACH SIMULATION RESULT BASED ON INITIAL AND SECOND MEASURED PRESSURES/ SLOPES
1520
SELECT TWO SIMULATION RESULTS CLOSEST TO THE MEASURED PRESSURES/ SLOPES
1522
COMPUTE NEXT INJECTION FLOW RATE BASED ON THE SELECTED SIMULATION RESULTS
1524
APPLY NEXT INJECTION FLOW RATE
1526
MEASURE SECOND INJECTION AND BUILDDOWN PRESSURES/SLOPES
1528
COMPUTE DISTANCE TO EACH SIMULATION RESULT BASED ON INITIAL AND SECOND MEASURED PRESSURES/SLOPES
1530
SELECT TWO SIMULATION RESULTS CLOSEST TO THE MEASURED PRESSURES/ SLOPES
1532
COMPUTE NEXT DRAWDOWN FLOW RATE BASED ON THE SELECTED SIMULATION RESULTS
1534
APPLY NEXT DRAWDOWN FLOW RATE
1536
MEASURE THIRD DRAWDOWN AND BUILDUP PRESSURES/SLOPES
1538
COMPUTE DISTANCE TO EACH SIMULATION RESULT BASED ON INITIAL, SECOND, AND THIRD MEASURED PRESSURES/SLOPES
1540
SELECT TWO SIMULATION RESULTS CLOSEST TO THE MEASURED PRESSURES/ SLOPES
1542
COMPUTE NEXT INJECTION FLOW RATE BASED ON THE SELECTED SIMULATION RESULTS
1544
APPLY NEXT INJECTION FLOW RATE

FIG. 16

1600

| Feature Pressure | Pref 01 (psi) | Pref 02 (psi) | Ptst (psi) | Feature Distance | Dref01 (psi) | Dref02 (psi) | Flow Ratio | Qratio (ref01) | Qratio (ref02) | Qratio |
|---|---|---|---|---|---|---|---|---|---|---|
| Pdd1 | 16521 | 16516 | 16438 | | | | | | | |
| Pbu1 | 16597 | 16605 | 16620 | | | | | | | |
| Pij1 | 17455 | 17464 | 17543 | | | | | | | |
| Pbd1 | 17380 | 17394 | 17381 | 4-input | 122.89 | 113.04 | Qdd2/Qij1 | 0.3929 | 0.3004 | 0.3447 |
| Pdd2 | 17039 | 17133 | 17055 | | | | | | | |
| Pbu2 | 17057 | 17145 | 17093 | 6-input | 129.21 | 146.57 | Qij2/Qdd2 | 0.1706 | 0.9310 | 0.5269 |
| Pij2 | 17115 | 17383 | 17259 | | | | | | | |
| Pbd2 | 17111 | 17355 | 17224 | 8-input | 224.78 | 232.32 | Qdd3/Qij2 | 0.3965 | 0.9122 | 0.6501 |
| Pdd3 | 17088 | 17135 | 17114 | | | | | | | |
| Pbu3 | 17089 | 17151 | 17129 | 10-input | 229.85 | 234.32 | Qij3/Qdd3 | 0.5306 | 0.2220 | 0.3778 |
| Pij3 | 17101 | 17200 | 17170 | | | | | | | |
| Pstb | 17097 | 17195 | 17149 | | | | | | | |

APPARATUS AND METHOD FOR PULSE TESTING A FORMATION

BACKGROUND

Downhole testing of a hydrocarbon containing formation of interest is often performed to determine whether commercial exploitation of the formation is viable and how to optimize production from the formation. For example, after a well or well interval has been drilled, zones of interest are often tested to determine various formation properties such as permeability, fluid type, fluid quality, formation temperature, formation pressure, bubblepoint, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities).

To perform formation testing, a formation testing tool is typically lowered downhole on a wireline or tubing string (e.g., a drill string). A region of the formation of interest is isolated from wellbore fluids, and valves or ports of the tool are opened to allow formation fluids to flow from the formation into a sampling chamber of the tool while pressure recorders measure and record the fluid pressure transients. The sample chamber of the formation testing tool may be formed by a cylinder. The volume of the sample chamber may be increased or decreased by translating a piston within the cylinder. To initiate fluid flow from the formation into the sample chamber, the piston is translated in the cylinder to increase the volume of the sample chamber, thereby lowering the fluid pressure inside the sample chamber in a process referred to as "drawdown." After drawdown is completed, formation fluid continues to flow into the sample chamber in a process referred to as "buildup." Conventionally, the pressure of fluid inside the sample chamber is monitored and recorded until it stabilizes, which indicates the formation pressure has been reached. The length of time required for the pressure to stabilize is referred to as the "stabilization" time, and conventional single drawdown/buildup tests for low mobility reservoirs may require several hours or days to stabilize, causing the loss of valuable drilling rig time.

To reduce formation testing time, pressure pulsing formation testing methods have been developed. According to such testing methods, (1) drawdown is performed as described above, (2) buildup is performed for a finite period of time less than the stabilization time, (3) the volume of the sample chamber is then decreased to generate a pressure pulse and inject a small amount of fluid back into the formation in a process referred to as "injection" or "pressure pulsing", and (4) fluid in the sample chamber is allowed to continue to flow into the formation in a process referred to as "builddown" until the pressure stabilizes, which indicates the formation pressure has been reached. A formation pulse test sequence may include a single pulse test or a sequence of multiple pulse tests.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form in the interest of clarity and conciseness.

FIG. 13 shows an illustrative table including feature pressure and slope values derived from simulated formation pulse tests in accordance with principles disclosed herein;

FIG. 14 shows an illustrative table including flow rate ratio values derived from simulated formation pulse tests in accordance with principles disclosed herein;

FIG. 15 shows a flow diagram for a method for performing a formation pressure test in accordance with principles disclosed herein;

FIG. 16 shows an illustrative table of formation pressure test values generated by operation of the method of FIG. 15;

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through direct engagement of the devices or through an indirect connection via other devices and connections. The recitation "based on" means "based at least in part on." Therefore, if X is based on Y, X may be based on Y and any number of other factors.

Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

DETAILED DESCRIPTION

To reduce formation pressure testing time, particularly with regard to low mobility reservoirs such as shale gas and heavy oil, embodiments of the present disclosure apply adaptive pressure pulse testing techniques. Prior to pulse testing a formation, pre-job designs are simulated over a range of formation parameters. The formation is adaptively pulse tested using the pressure responses recorded during each phase of the pulse test, and the results of the pre-job designs, to optimize a pulse parameter applied at a next step of the pulse test. Thus, embodiments disclosed herein can determine reservoir pressure and permeability in a reduced time period, for example, usually less than 1 hour. In addition, the test results can be further analyzed with optimization method and inverse algorithm to yield more information about the reservoir properties.

Figure 1:
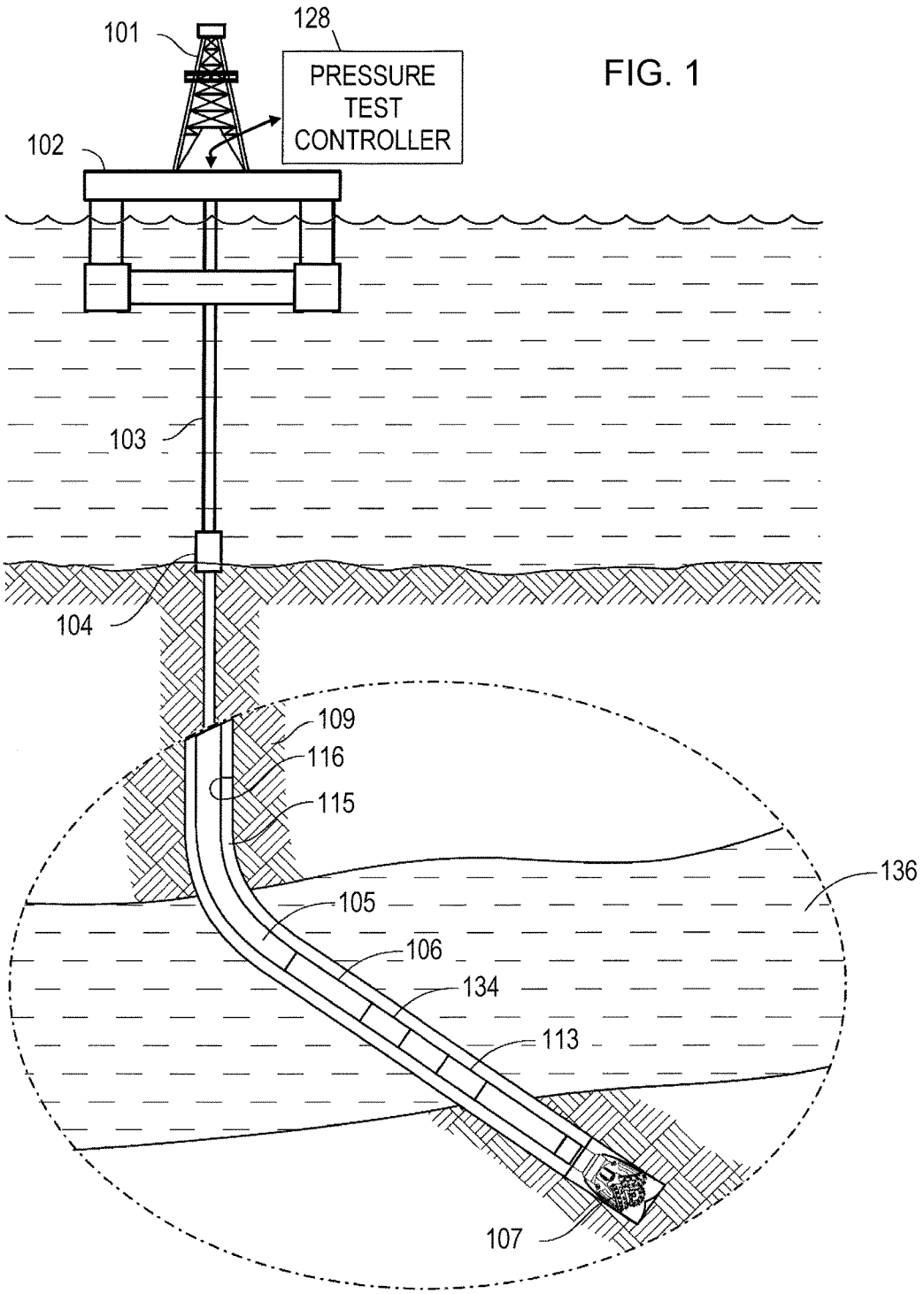
FIG. 1 shows a schematic view, partly in cross-section, of an embodiment of a drilling system including a formation pressure test tool in accordance with principles disclosed herein.

Referring initially to FIG. 1, a drilling system including a formation test tool 134 is shown. The formation test tool 134 is shown enlarged and schematically as a part of a bottom hole assembly 106 including a sub 113 and a drill bit 107 at its distal most end. The bottom hole assembly 106 is lowered from a drilling platform 102, such as a ship or other conventional land platform, via a drill string 105. The drill string 105 is disposed through a riser 103 and a well head 104. Conventional drilling equipment (not shown) is supported within a derrick 101 and rotates the drill string 105 and the drill bit 107, causing the bit 107 to form a borehole 116 through formation material 109. The drill bit 107 may also be rotated using other means, such as a downhole motor. The borehole 116 penetrates subterranean zones or reservoirs, such as a reservoir of formations 136, that are believed to contain hydrocarbons in a commercially viable quantity. An annulus 115 is formed thereby. In addition to the formation test tool 134, the bottom hole assembly 106 may include various conventional apparatus and systems, such as a down hole drill motor, a rotary steerable tool, a mud pulse telemetry system, MWD or LWD sensors and systems, downhole memory and processor, and other downhole components known in the art.

The formation test tool 134 includes one or more packers, valves, or ports that may be opened and closed, and one or more pressure sensors. The tool 134 is lowered to a zone to be tested, the packers are set, and drilling fluid is evacuated to isolate the zone from a drilling fluid column (not shown). The valves or ports are then opened to allow flow from the formation to the tool for testing while the pressure sensors measure and record the pressure transients. Some embodiments of the formation test tool 134 use probe assemblies (not shown) rather than conventional packers, where the probe assemblies isolate only a small circular region on the wall of the borehole 116. Embodiments of the formation test tool 134 are configured for operation in high-temperature and/or high pressure environments such as may be encountered in some wells.

A pressure test controller 128 is communicatively coupled to the formation test tool 134. The pressure test controller 128 controls testing operations performed in the borehole 116 by the formation test tool 134, and analyzes pressure measurements provided by the formation test tool 134. In some embodiments, the pressure test controller 128 is disposed at the surface and provides control information to and receives pressure measurements from the formation test tool 134 via a downhole telemetry system. The downhole telemetry system may provide communication via mud pulse, wired drill pipe, acoustic signaling, electromagnetic transmission, or other downhole data communication technique. In some embodiments, the pressure test controller 128 may be a component of the formation test tool 134 or another downhole tool communicatively coupled to the formation test tool 134 (e.g., by a downhole telemetry system).

Using conventional formation pressure testing techniques, considerable time, and associated cost, may be required to determine formation pressure. Embodiments of the pressure test controller 128 accelerate formation pressure testing by determining testing parameters to be applied by the formation test tool 134 in accordance with results of previously executed formation pressure test simulations. The simulations are optimized to reduce (e.g., minimize) formation pressure testing time. The pressure test controller 128 adaptively determines flow rates to be used for pulsed formation testing by identifying simulations including pressure values closest to the pressures values measured by the formation test tool 134 and computing a flow rate to be applied in a next portion or stage of the formation test based on the flow rates applied in the corresponding portion, of the identified simulations. Thus, embodiments of the pressure test controller 128 reduce the time and cost associated with formation pressure testing.

Figure 2:
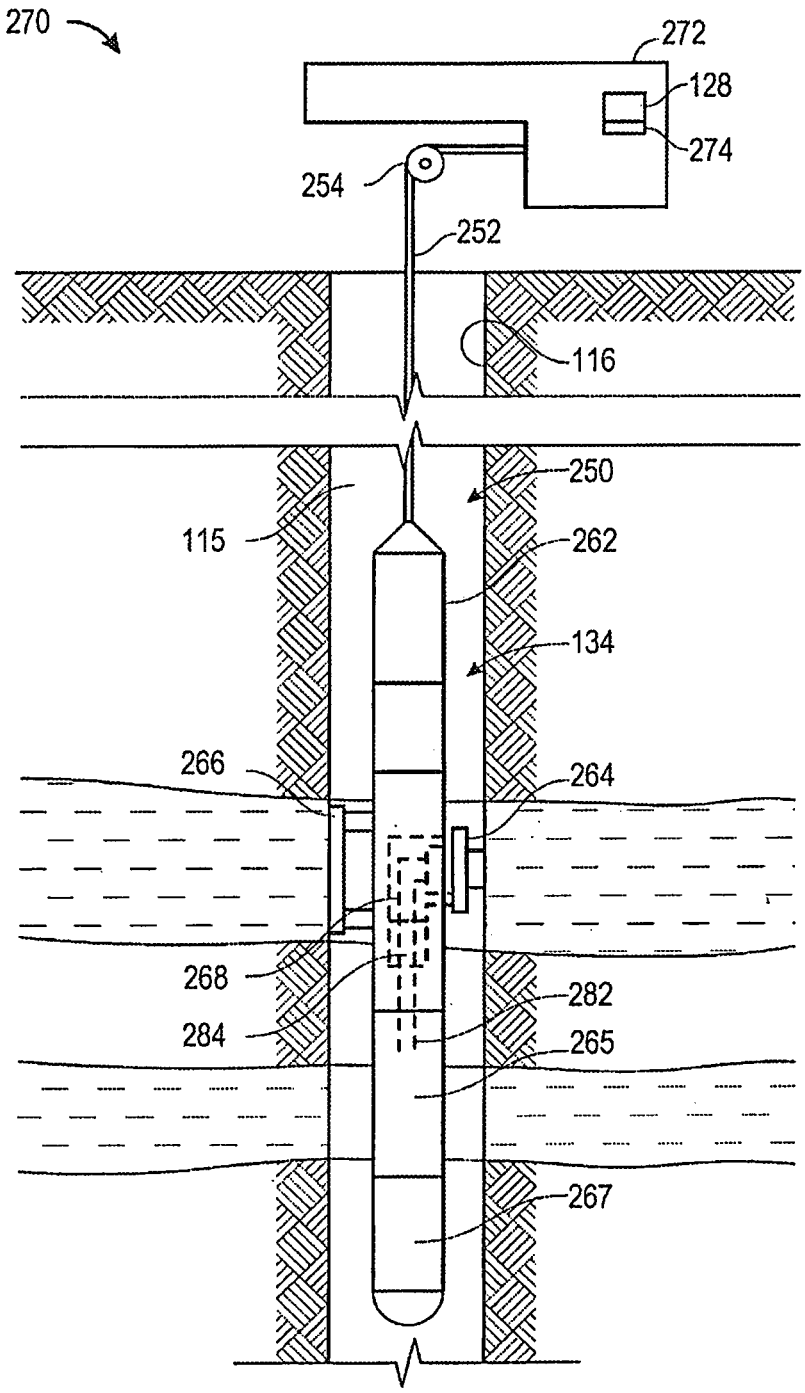
FIG. 2 shows a schematic view, partly in cross-section, of an embodiment of a formation pressure test tool conveyed by wireline in accordance with principles disclosed herein.

In some embodiments, and with reference to FIG. 2, the formation test tool 134 may be disposed on a tool string 250 conveyed into the borehole 116 by a cable 252 and a winch 254. The formation test tool 134 includes a body 262, a sampling assembly 264, a backup assembly 266, analysis modules 268, 284 including electronic devices, a flowline 282, a battery module 265, and an electronics module 267, or subcombinations thereof. The formation test tool 134 is coupled to a surface unit 270 that may include an electrical control system 272. The electrical control system 272 may include the pressure test controller 128 and other electronic systems 274. In other embodiments, the formation test tool 134 may alternatively or additionally include the pressure test controller 128.

Figure 3:
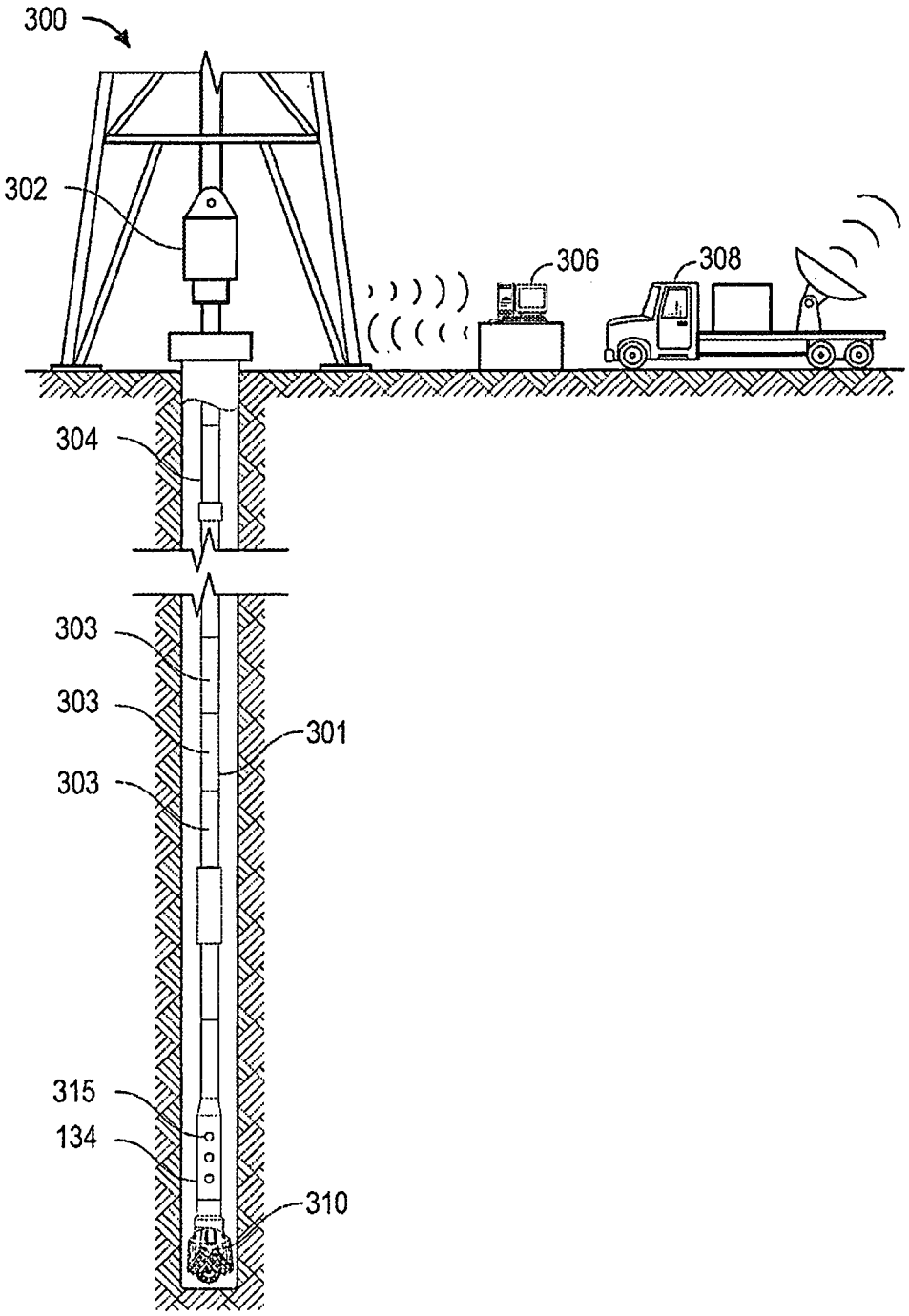
FIG. 3 shows a schematic view, partly in cross-section, of a formation pressure test tool disposed on a wired drill pipe connected to a telemetry network in accordance with principles disclosed herein.

Referring to FIG. 3, a telemetry network 300 is shown. A formation test tool 134 is coupled to a drill string 301 formed by a series of wired drill pipes 303 connected for communication across junctions using communication elements. It will be appreciated that work string 301 can be other forms of conveyance, such as wired coiled tubing. The downhole drilling and control operations are interfaced with the rest of the world in the network 300 via a top-hole repeater unit 302, a kelly 304 or top-hole drive (or, a transition sub with two communication elements), a computer 306 in the rig control center, and an uplink 308. The computer 306 can act as a server, controlling access to network 300 transmissions, sending control and command signals downhole, and receiving and processing information sent up-hole. The software running the server can control access to the network 300 and can communicate this information via dedicated land lines, satellite uplink 308, Internet, or other means to a central server accessible from anywhere in the world. The formation tester 320 is shown linked into the network 300 just above the drill bit 310 for communication along its conductor path and along the wired drill string 301. In some embodiments, the pressure test controller. 128 may be included in the computer 306.

The formation test tool 134 may include a plurality of transducers 315 disposed on the formation tester 320 to relay downhole information to the operator at surface or to a remote site. The transducers 315 may include any conventional source/sensor (e.g., pressure, temperature, gravity, etc.) to provide the operator with formation and/or borehole parameters, as well as diagnostics or position indication relating to the tool. The telemetry network 300 may combine multiple signal conveyance formats (e.g., mud pulse, fiber-optics, acoustic, EM hops, etc.). It will also be appreciated that software/firmware and associated processors may be included in the formation test tool 134 and/or the network 300 (e.g., at surface, downhole, in combination, and/or remotely via wireless links tied to the network).

Figure 4:
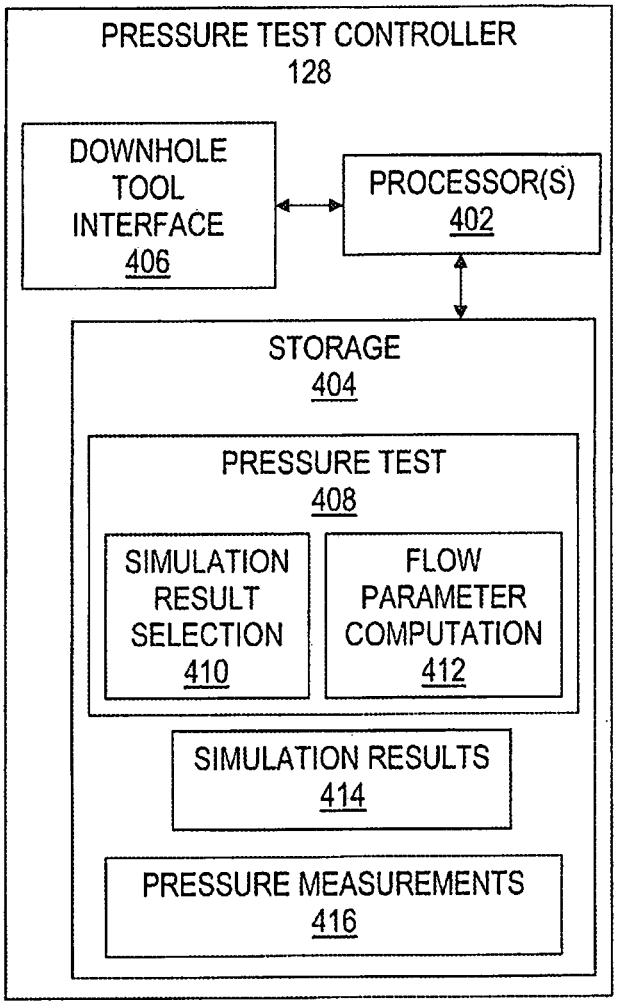
FIG. 4 shows a block diagram for a formation pressure test controller configured to control formation pressure testing in accordance with principles disclosed herein.

FIG. 4 shows a block diagram of the pressure test controller 128. The pressure test controller 128 includes one or more processors 402 and storage 404 coupled to the processor(s) 402. The pressure test controller 128 may also include a downhole tool interface 406 that provides for input of data to the pressure test controller 128 and output of data from the pressure test controller 128. For example, the downhole tool interface 406 may include wired and/or wireless network interfaces (e.g., IEEE 802.3, IEEE 802.11, etc.) or other interfaces for communicating with the formation test tool 134 via a downhole telemetry system. The pressure test controller. 128 may further include user input interfaces (universal serial bus, keyboard, pointing device, etc.), data display interfaces (monitors, plotters, etc.), and the like. Some embodiments of the pressure test controller 128 may be implemented using computers, such as desktop computers, laptop computers, rack-mount computers, or other computers known in the art.

The processor(s) 402 may include, for example, one or more general-purpose microprocessors, digital signal processors, microcontrollers, or other suitable instruction execution devices known in the art. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems. Processors execute software instructions. Instructions alone are incapable of performing a function. Therefore, any reference herein to a function performed by software instructions, or to software instructions performing a function is simply a shorthand means for stating that the function is performed by a processor executing the instructions.

The storage 404 is a non-transitory computer-readable storage device and includes volatile storage such as random access memory, non-volatile storage (e.g., a hard drive, an optical storage device (e.g., CD or DVD), FLASH storage, read-only-memory), or combinations thereof. The storage 404 includes a formation pressure test module 408 that when executed causes the processor(s) 402 to pulse pressure test the formation 136 with adaptive pulse flow rate determination based on results of previously executed pressure tests simulations and measured formation pressures.

The formation pressure test module 408 includes formation simulation results 414 produced by simulating formation pressure tests, formation pressure measurements 416 retrieved from the formation test tool 134, a simulation result selection module 410, and a flow parameter computation module 412. The simulation result selection module 410 compares pressure measurements 416 to pressure values of the simulation results 414 and identifies the simulation results including formation pressures closest to the corresponding formation pressure measurements 416. The flow parameter computation module 412 determines a flow rate to be applied by the formation test tool 134 in a next pulse of the formation test. The flow parameter computation module 412 determines the flow rate based on the flow rates associated with the identified simulation results. Thus, the formation pressure test module 408 adapts the formation pulse test to the measured formation pressures based on the results 414 of optimized formation pressure test simulations, thereby reducing formation pressure test time. The operations of the formation pressure test module 408 are explained in further detail herein with regard to the testing method 1500.

Figure 5:
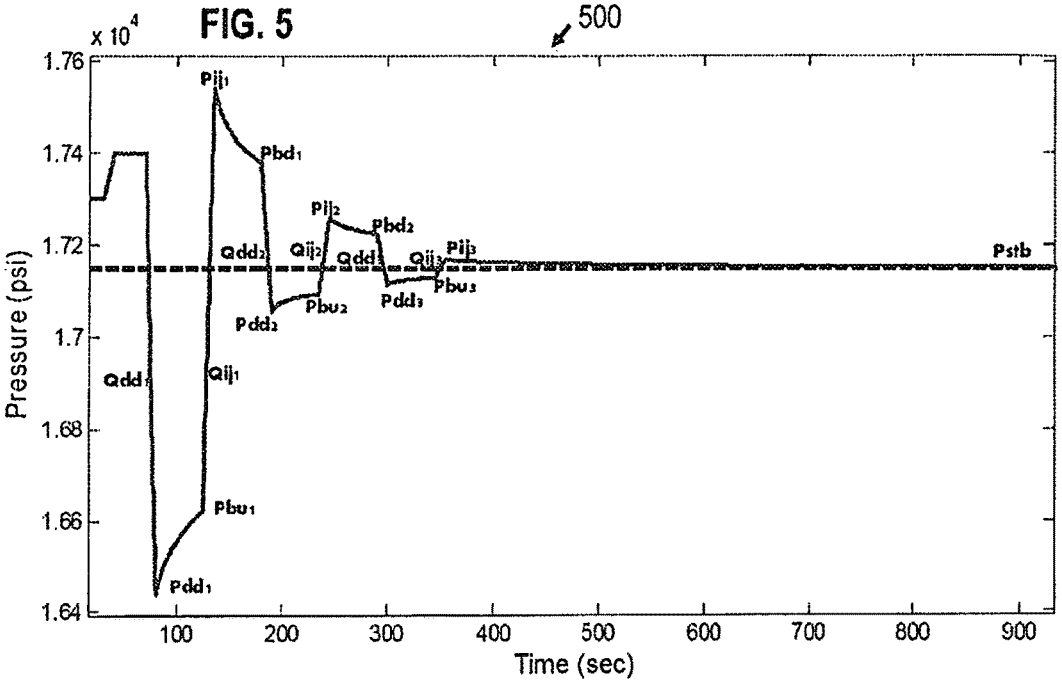
FIG. 5 shows an illustrative plot of a formation pulse test profile in accordance with principles disclosed herein.

FIG. 5 shows an illustrative plot 500 of a formation pulse test sequenced by the formation test controller 128 in accordance with principles disclosed herein. The pulse test plot 500 identifies formation pressures measured and flow rates applied during the pulse test. The flow rates are representative of pulse parameters which are used in conjunction with other pulse parameters such as drawdown/injection pulse time and buildup/builddown interval to minimize stabilization time. In the plot 500:

Q represents pump-out flow rate;

P represents formation pressure;

dd represents drawdown;

bu represents buildup;

ij denotes injection;

bd denotes builddown; and numerical subscripts (1, 2, 3) indicate sequence of activity.

Figure 6:
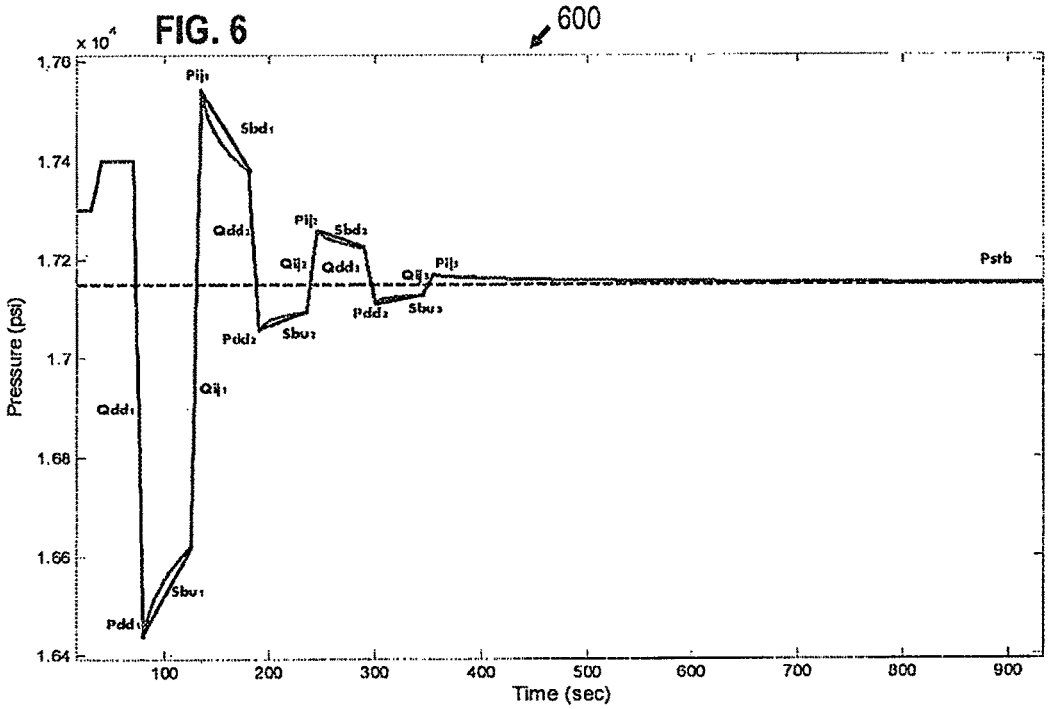
FIG. 6 shows an illustrative plot of a formation pulse test profile including pressure slope values in accordance with principles disclosed herein.

FIG. 6 shows an illustrative plot of a formation pulse test profile 600 for a formation pulse test sequenced by the formation test controller 128 in accordance with principles disclosed herein. The pulse test plot 600 generally identifies flow rates applied and formation pressures measured during the pulse test similar to those of profile 500. However, the profile 600 further identifies a slope (S) of pressure change during shut-in intervals. Some embodiments of the formation test controller 128 determine and apply the slope of pressure change during shut-in intervals, rather than the measures pressure values at the start and end of the shut-in interval (as shown in FIG. 5). Application of slope, rather than instantaneous pressure measurements, in adaptive formation pressure testing can provide improved immunity from noise affecting instantaneous pressure measurements. Thus, embodiments of the formation test controller 128 may determine a flow rate based on formation pressure values that include 1) instantaneous or single formation pressure measurements; and/or 2) pressure change slope values that are derived from formation pressure measurements.

While the slopes illustrated in profile 600 are linear, some embodiments of the formation test controller 128 may generate and apply non-linear slopes. For example, embodiments of the formation test controller 128 may generate and apply a slope in accordance with a function based on Darcy's law.

Some embodiments of the formation pressure testing system disclosed herein apply fixed drawdown and/or injection pulse times, and/or fixed shut-in times for pressure buildup and/or builddown.

Because parameters of subsurface formations are uncertain, parameters applied in pressure testing simulations executed prior to downhole pressure testing are varied over a range encompassing likely downhole formation parameters. Some embodiments apply the fixed pulse profile 500 shown in FIG. 5 for simulation and downhole testing. Some embodiments may apply different pulse patterns. The formation pressure test simulations shown in FIGS. 4-8 apply the following parameters:

Hydrostatic pressure: 17300 pounds per inch$^2$ (psi);

Initial formation pressure: 16800 to 17200 psi;

Rock permeability: 0.00025 to 0.005 millidarcy (mD);

Formation porosity: 0.10 to 0.20 or 10 to 20 porosity unit (PU);

Flow line volume: 33000 to 41000 centimeter$^3$ (cc) for straddle packer;

Fluid and mud filtrate compressibility: 2.5e-06 to 3.5e-06 (1/psi).

In executing the simulations that generate the simulation results 414, some embodiments change only a single parameter value per simulation while keeping all other parameter values constant. Each simulation is optimized by evolving sequential pulse parameters to minimize overall test stabilization time. Thus, the simulation results 414 may represent optimum formation pulse testing times for the constant parameters of the simulation.

Figure 7:
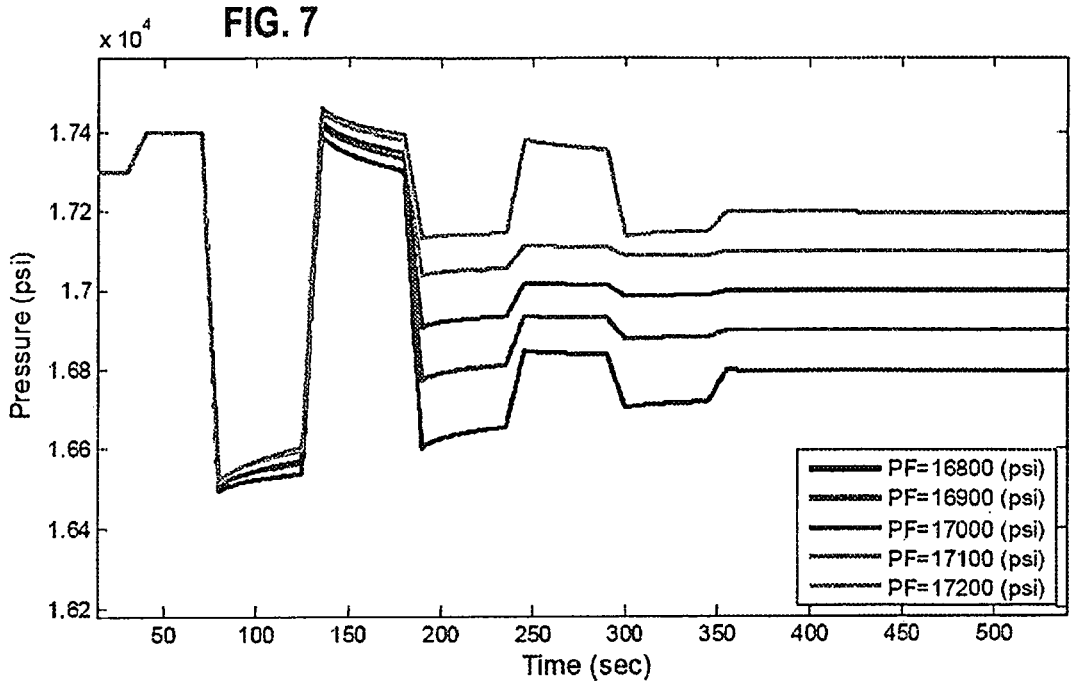
FIG. 7 shows illustrative plots of simulated pulse test response with flow rates optimized as a function of initial formation pressure.

FIGS. 7-11 show plots of simulated pulse test responses. The simulations of FIGS. 7-11 use fixed pulse time and shut-in time for simplicity. Thus, only flow rates applied to sequential pulse tests are parameters to be optimized. FIG. 7 shows illustrative plots of simulated pulse test responses with flow rates optimized as a function of initial formation pressure. Other formation parameters applied in the simulations are set as follows:

permeability K=0.001 mD, porosity Ø=0.15, flowline volume V=37000 cc,

Cf (fluid compressibility)=Cm (mud filtrate compressibility)=3.0e-06 (1/psi).

FIG. 7 shows that using the fixed pulse profile 500 of FIG. 5, the resulting simulation can be optimized to provide equivalently low stabilization cost. Also, the formation pressure related test response can be changed drastically at and after the second drawdown.

Figure 8:
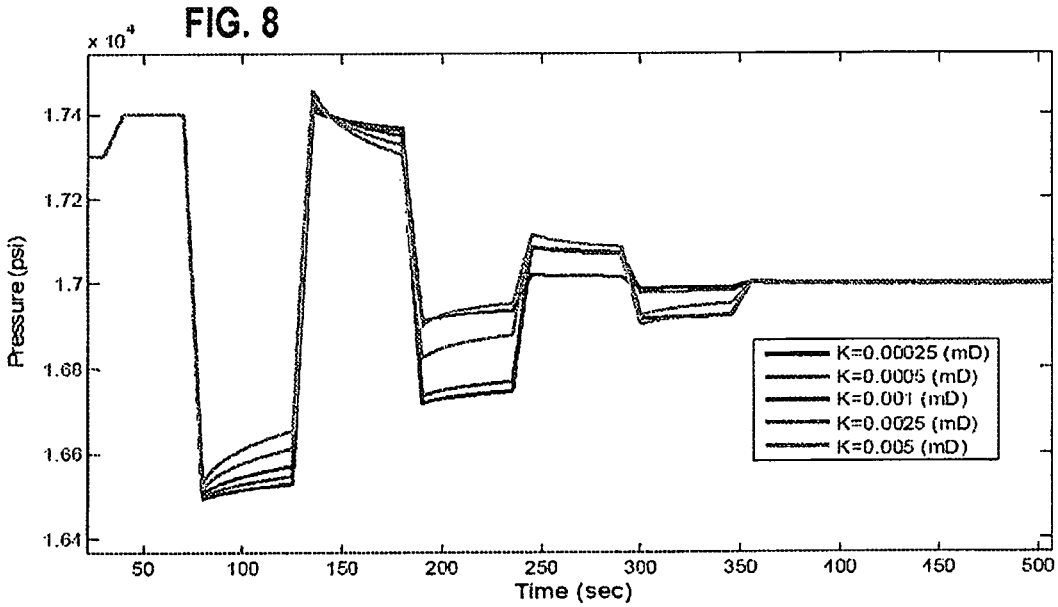
FIG. 8 shows illustrative plots of simulated pulse test response with flow rates optimized as a function of rock permeability.

FIG. 8 shows illustrative plots of simulated pulse test responses with flow rates optimized as a function of rock permeability. Rock permeability significantly affects slope change of shut-in tests. Other formation parameters applied in the simulations are set as follows:

initial pressure Pi=17000 psi, porosity Ø=0.15, flowline volume V=37000 cc, fluid compressibility Cf=Cm=3.0e-06 (1/psi).

Figure 9:
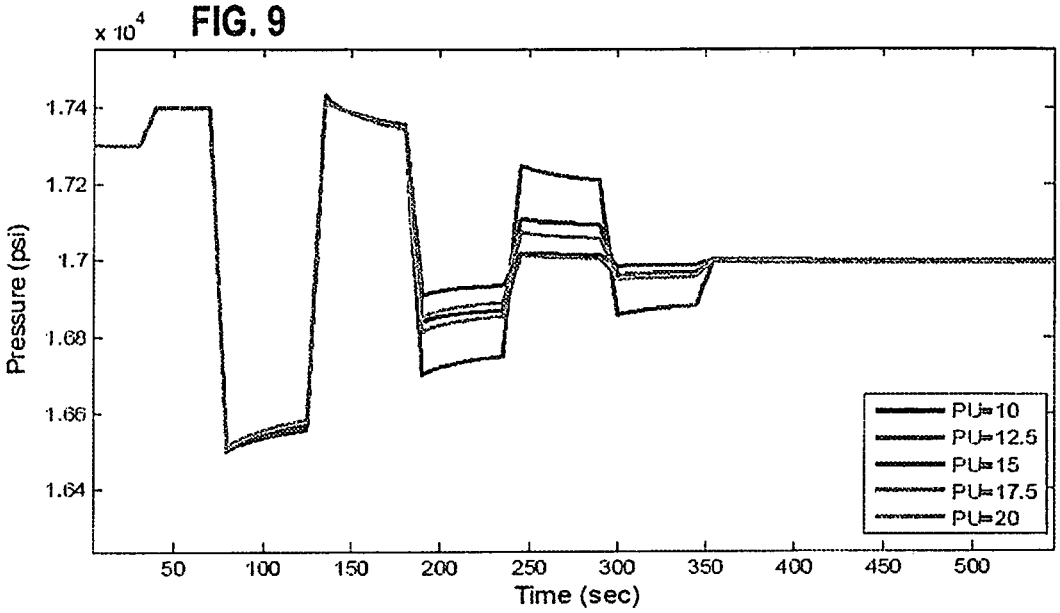
FIG. 9 shows illustrative plots of simulated pulse test response with flow rates optimized as a function of formation porosity.

FIG. 9 shows illustrative plots of simulated pulse test response with flow rates optimized as a function of formation porosity. The first drawdown and first injection response are less affected by porosity change in these simulations. The other formation parameters applied in the simulations are set as follows:

initial pressure Pi=17000 psi, permeability K=0.001 mD, flowline volume V=37000 cc, fluid compressibility Cf=Cm=3.0e-06 (1/psi).

Figure 10:
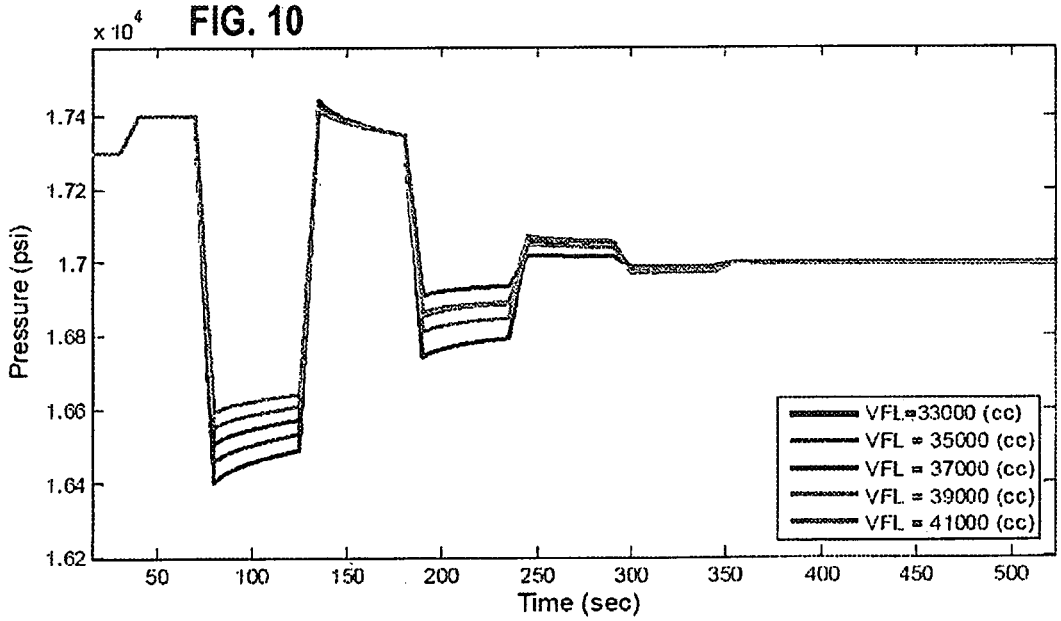
FIG. 10 shows illustrative plots of simulated pulse test response with flow rates optimized as a function of flowline volume.

FIG. 10 shows illustrative plots of simulated pulse test response with flow rates optimized as a function of flowline volume. Flowline volume affects drawdown pressures leading to near-parallel shut-in response. The other formation parameters applied in the simulations are set as follows:

initial pressure Pi=17000 psi, permeability K=0.001 mD, porosity Ø=0.15, fluid compressibility Cf=Cm=3.0e-06 (1/psi).

Figures 11, 12:
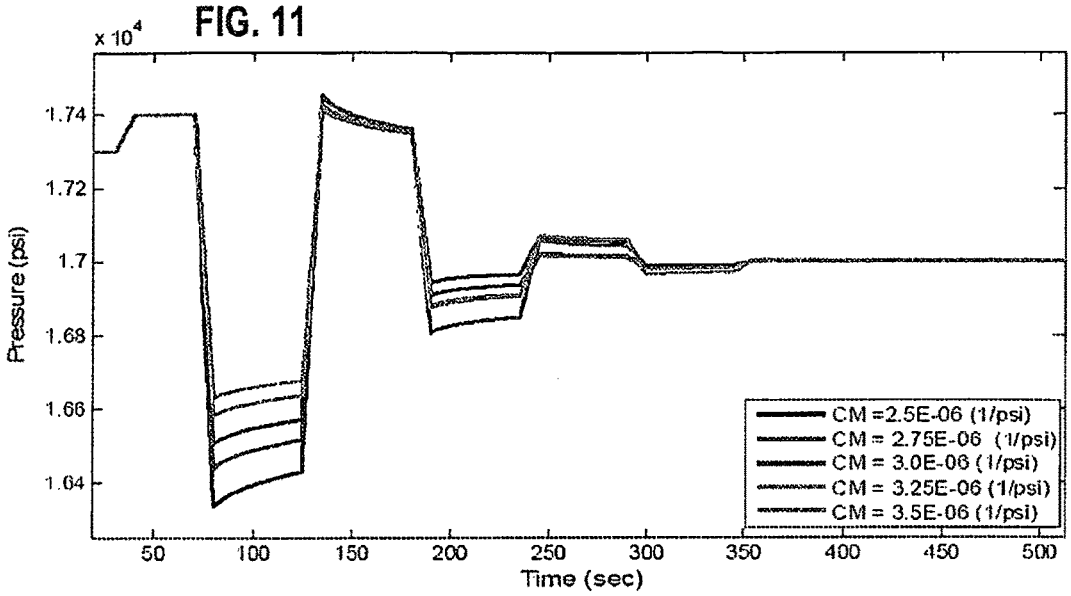
FIG. 11 shows illustrative plots of simulated pulse test response with flow rates optimized as a function of fluid compressibility.
FIG. 12 shows an illustrative table including feature pressure values derived from simulated formation pulse tests in accordance with principles disclosed herein.

FIG. 11 shows illustrative plots of simulated pulse test response with flow rates optimized as a function of fluid compressibility. Fluid compressibility change can introduce pressure response similar to that introduced by flowline volume as shown in FIG. 10. The other formation parameters applied in the simulations are set as follows:

initial pressure Pi=17000 psi, permeability K=0.001 mD, porosity Ø=0.15, flowline volume VF=37000 cc.

The simulations produce results, e.g., pressures and flow rates, that minimize or reduce the pressure testing time for the formation simulated. The simulation parameters (pressures and flow rates) are stored in the simulation results 414. In some embodiments that simulation results 414 are stored remotely from the pressure test controller 128 and accessed via a communication-network. In other embodiments, the simulation results 414 are stored local to the pressure test controller 128.

FIGS. 12-14 show illustrative simulation results organized as tables stored in the simulation results 414. The table 1200 includes pressure values generated by each of twenty-one different optimal simulations. The table 1300 includes pressure and slope values generated by each of twenty-one different optimal simulations. Table 1400 includes flow rate ratios applied to the twenty-one simulations corresponding to either of Tables 1200 and 1300. While results of twenty-one different pulse pressure test simulations are shown in Tables 1200-1400, embodiments of the simulation results 414 may include results of any number simulations.

FIG. 15 shows a flow diagram for a method 1500 for performing a formation pressure test in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 1500 can be performed by the processor(s) 402 of the pressure test controller 128 executing instructions read from a computer-readable medium (e.g., the storage 204). While the method 1500 is described with reference to the pulse test profiles 500 and 600 of FIGS. 3 and 4, some embodiments may implement a different pulse profile, for example, a profile including a different number and/or polarity of pulses from that shown in profiles 500, 600.

In general, the method 1500 adaptively determines a flow rate value to apply in a next portion, stage, or pulse of the formation pressure test based on flow ratios of selected ones of the simulation results 414. The selected ones of the simulation results 414 are identified based on distance between a cumulative set of pressure/slope values derived from information provided by the formation test tool 134 over the duration of the test and corresponding pressure/slope values of the simulations of the simulation results 414.

In block 1502, pulse pressure test simulations are executed. The simulations may be executed as pre-job designs by the pressure test controller 128 or by a different system. The simulations produce optimal pulse pressure test parameters that the pressure test controller 128 employs to adaptively reduce the time required to pulse pressure test the downhole formations 136. Any number of simulations may be executed to accommodate uncertainty in the parameters of the downhole formations 136. The results of the simulations are provided to the pressure test controller 128 as simulation results 414. For explanatory purposes, the simulation results 414 may include Table 1400 and at least one of Tables 1200, 1300.

In block 1504, the formation test tool 134 is disposed in the borehole 116 to pulse pressure test the formations 136. The pressure test controller 128 provides initial test parameters to the formation test tool 134. The initial test parameters include flow rates ($Odd_1$ and $Qij_1$) to be applied in a first stage of the pulse pressure test. The initial parameters may be the same as the corresponding parameters applied in the simulations.

The formation test tool 134 executes an initial drawdown, buildup, and builddown in accordance with the received initial parameters, and measures initial pressure values in block 1506. The initial pressure values may include drawdown, buildup, injection, and builddown pressures. The measured initial pressure values are provided to the pressure test controller 128. One of the formation test tool 134 and the pressure test controller 128 may compute an initial buildup slope value based on the initial pressure values. FIG. 16 shows illustrative parameter values where:

Ptst contains measured formation pressure values; and

Pref01 and Pref02 contain simulation pressure values retrieved from the simulation results 414.

The initial measured pressure/slope values include $Pdd_1$, $Pbu_1/Sbu_1$, $Pij_1$, and $Pbd_1/Sbd_1$ values of Ptst.

In block 1508, the pressure test controller 128 computes the distance between the measured initial pressure/slope values derived from information provided by the formation test tool 134 and the corresponding pressure/slope values of each of the results of a simulation stored in simulation results 414. In some embodiments, the distance between the measured initial pressure/slope values and corresponding simulated pressure/slope values is computed as Euclidean distance. Some embodiments may apply a different distance measurement algorithm.

In block 1510, the pressure test controller 128, based on the computed distances between the measured initial pressure/slope values and the corresponding pressure/slope values of simulation results, selects two simulation results having pressure/slope values closest to the measured initial pressure/slope values. The distance measurements indicate that simulations 4 and 5 of Tables 1200 and 1300 are closest to the measured initial pressure/slope values and corresponding pressure/slope values of simulations 4 and 5 are shown in columns Pref01 and Pref02 of Table 1600. The computed minimum distance values are shown in columns Dref01 and Dref02 of Table 1600.

In block 1512, the pressure test controller 128 computes, based on the selected simulation results, a drawdown flow rate to apply in a next stage of the formation pressure test. Some embodiments apply the simulation flow ratio corresponding to the simulated $Pbd_1/Sbd_1$, of the selected simulations, closest to the measured $Pbd_1/Sbd_1$. In some embodiments, if the measured builddown value $Pbd_1/Sbd_1$ is between the two corresponding simulation pressure/slope values of the selected simulations, then the ratio to be applied to generate the next flow rate will be a weighted sum of the two simulation flow ratios of simulations 4 and 5 of Table 1400, where the weighting factors are inversely proportional to the distance to the simulation pressure/slope. In the present example, Pref01<Ptst<Pref02, and the ratio $Qdd_2/Qij_1$ is computed as:

$$Qratio = W1 \times Qratio_ref01 + W2 \times Qratio_ref02$$

where:

$$W1 = Dref02/(Dref01 + Dref02) = 113.04/(122.89 + 113.04) = 0.4791, \text{ and}$$

$$W2 = 1 - W1 = 0.5209.$$

The values of Qratio (ref01) and Qratio (ref02) shown in Table 1600 are extracted from simulations 4 and 5 of Table 1400. Thus, the pressure test controller 128 computes Qratio as:

$$Qratio = 0.4791 \times 0.3929 + 0.5209 \times 0.3004 = 0.3447,$$

resulting in drawdown flow rate ($Qdd_2$) of 3.447 cc/second, where Qij1 is 10 cc/second, to apply in the second stage of the test.

In block 1514, the pressure test controller 128 provides the next drawdown flow rate $Qdd_2$ to the formation test tool 134. The formation test tool 134 applies $Qdd_2$, and in block 1516 second pressure/slope values are measured. (e.g., $Pdd_2$ and $Pbu_2/Sbu_2$).

The pressure test controller 128 retrieves the second measured pressure/slope values ($Pdd_2$ and $Pbu_2/Sbu_2$), and in block 1518, computes the distance between the measured initial and second pressure/slope values and the corresponding pressure/slope values of each of the results of a simulation stored in simulation results 414. Thus, the distance measurement of block 1518 measures distance between the six measured initial and second pressure/slope values ($Pdd_1$, $Pbu_1/Sbu_1$, $Pij_1$, $Pbd_1/Sbd_1$, $Pdd_2$, and $Pbu_2/Sbu_2$) and the corresponding pressure/slope values of each simulation of the simulation results 414.

In block 1520, the pressure test controller 128, based on the computed distances between the measured initial and second pressure values and the corresponding pressure values of simulation results, selects two simulation results having pressure/slope values closest to the measured pressure/slope values. The distance measurements indicate that simulations 4 and 5 of Tables 1200/1300 and 1400 are closest to the measured pressure/slope values and corresponding pressure/slope values of simulations 4 and 5 are shown in columns Pref01 and Pref02 of Table 1600. The computed minimum distance values are shown in columns Dref01 and Dref02 of Table 1600.

In block 1522, the pressure test controller 128 computes, based on the selected simulation results, an injection flow rate to apply in a next stage of the formation pressure test. The injection flow rate may be computed using a weighted sum of the two simulation flow ratios ($Qij_2/Qdd_2$) of simulations 4 and 5 of Table 1400, in a fashion similar to that described above with regard to Qdd2 computation in block 1512. The weighted sum of the simulation Qratios 0.1706 and 0.9301 results in a Qratio of 0.5269 to apply for generation of $Qij_2$.

In block 1524, the pressure test controller 128 provides the next injection flow rate $Qij_2$ to the formation test tool 134. The formation test tool 134 applies $Qij_2$, and in block 1526, second injection and builddown pressure/slope values are measured (e.g., $Pij_2$ and $Pbd_2/Sbd_2$).

The pressure test controller 128 retrieves the second measured injection and builddown pressure/slope values ($Pij_2$ and $Pbd_2/Sbd_2$), and in block 1528, computes the distance between the measured initial and second pressure/slope values and the corresponding pressure/slope values of each of the results of a simulation stored in simulation results 414. Thus, the distance measurement of block 1518 measures distance between the eight measured initial and second pressure/slope values ($Pdd_1$, $Pbu_1/Sbu_1$, $Pij_1$, $Pbd_1/Sbd_1$, $Pdd_2$, $Pbu_2/Sbu_2$, $Pij_2$, and $Pbd_2/Sbd_2$) to the corresponding pressure/slope values of each simulation of the simulation results 414.

In block 1530, the pressure test controller 128, based on the computed distances between the measured initial and second pressure/slope values and the corresponding pressure/slope values of simulation results, selects two simulation results having pressure/slope values closest to the measured pressure/slope values. The distance measurements indicate that simulations 4 and 5 of Tables 1200/1300 and 1400 are closest to the measured pressure/slope values and corresponding pressure/slope values of simulations 4 and 5 are shown in columns Pref01 and Pref02 of Table 1600. The computed minimum distance values are shown in columns Dref01 and Dref02 of Table 1600.

In block 1532, the pressure test controller 128 computes, based on the selected simulation results, a drawdown flow rate to apply in a next stage of the formation pressure test. The drawdown flow rate may be computed using a weighted sum of the two simulation flow ratios ($Qdd_3/Qij_2$) of simulations 4 and 5 of Table 1400, in a fashion similar to that described above with regard to $Qdd_2$ computation in block 1512. The weighted sum of the simulation Qratios 0.3965 and 0.9122 results in a Qratio of 0.6501 to apply for generation of $Qdd_3$.

In block 1534, the pressure test controller 128 provides the next drawdown flow rate $Qdd_3$ to the formation test tool 134. The formation test tool 134 applies $Qdd_3$, and in block 1536, third drawdown and buildup pressure/slope values are measured (e.g., $Pdd_3$ and $Pbu_3/Sbu_3$).

The pressure test controller 128 retrieves the third measured drawdown and buildup pressure/slope values ($Pdd_3$ and $Pbu_3/Sbu_3$), and in block 1538, computes the distance between the measured initial, second, and third pressure/slope values retrieved from the formation test tool 134 and the corresponding pressure/slope values of each of the results of a simulation stored in simulation results 414. Thus, the distance measurement of block 1538 measures distance between the ten measured initial, second, and third pressure/slope values ($Pdd_1$, $Pbu_1/Sbu_1$, $Pij_1$, $Pbd_1/Sbd_1$, $Pdd_2$, $Pbu_2/Sbu_2$, $Pij_2$, $Pbd_2/Sbd_2$, $Pdd_3$, and $Pbu_3/Sbu_3$) to the corresponding pressure/slope values of each simulation.

In block 1540, the pressure test controller 128, based on the computed distances between the measured pressure/slope values and the corresponding pressure/slope values of simulation results, selects two simulation results having pressure/slope values closest to the measured pressure/slope values. The distance measurements indicate that simulations 4 and 5 of Tables 1200/1300 and 1400 are closest to the measured pressure/slope values and corresponding pressure/slope values of simulations 4 and 5 are shown in columns Pref01 and Pref02 of Table 1600. The computed minimum distance values are shown in columns Dref01 and Dref02 of Table 1600.

In block 1542, the pressure test controller 128 computes, based on the selected simulation results, an injection flow rate to apply in a next stage of the formation pressure test. The injection flow rate may be computed using a weighted sum of the two simulation flow ratios ($Qij_3/Qdd_3$) of simulations 4 and 5 of Table 1400, in a fashion similar to that described above with regard to $Qdd_2$ computation in block 1512. The weighted sum of the simulation Qratios 0.5306 and 0.2220 results in a Qratio of 0.3778 to apply for generation of $Qij_3$.

In block 1544, the pressure test controller 128 provides the next injection flow rate $Qij_3$ to the formation test tool 134. The formation test tool 134 applies $Qij_3$, and measures the formation pressure as the pressure stabilizes from injection pressure $Pij_3$.

In some embodiments of the method 1500, the measured formation pressure values are instantaneous pressure values measured at a discrete point in time. Alternatively, to reduce the effects of transient noise on the pressure measurements, the measured pressure values may be derived from a function fit to pressure values measured at discrete points in time, or derived from a measured rate of pressure change over a given measurement time interval.

Figure 17:
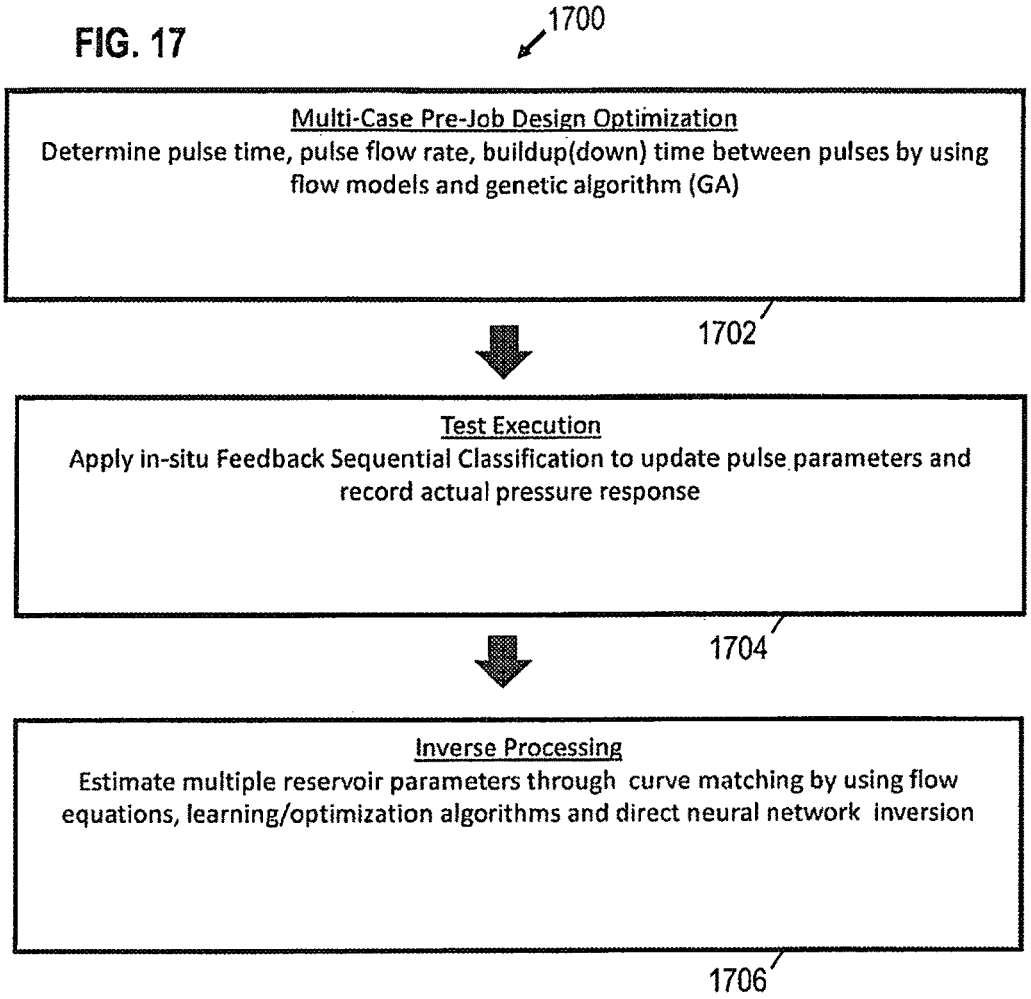
FIG. 17 shows a flow diagram for a method for estimating reservoir parameters in accordance with principles disclosed herein.

FIG. 17 shows a more general flow diagram for a method 1700 for estimating reservoir parameters in accordance with pulse testing principles disclosed herein. Though depicted sequentially as a matter of convenience, at least some of the actions shown can be performed in a different order and/or performed in parallel. Additionally, some embodiments may perform only some of the actions shown. At least some of the operations of the method 1700 can be performed by the processor(s) 402 of the pressure test controller 128 executing instructions read from a computer-readable medium (e.g., the storage 204).

In block 1702, pre-job design optimization simulations are performed. Pulse time, flow rates, buildup and buildown times are determined for various representations of formation 136 over a range of presumptive formation parameters. Flow models and genetic algorithms may be applied to perform the simulations.

In block 1704, the downhole formation 136 is adaptively pulse pressure tested based on the results of the optimized simulations. For example, the formation 136 may pulse pressure tested in accordance with the method 1500 disclosed herein.

Figure 18:
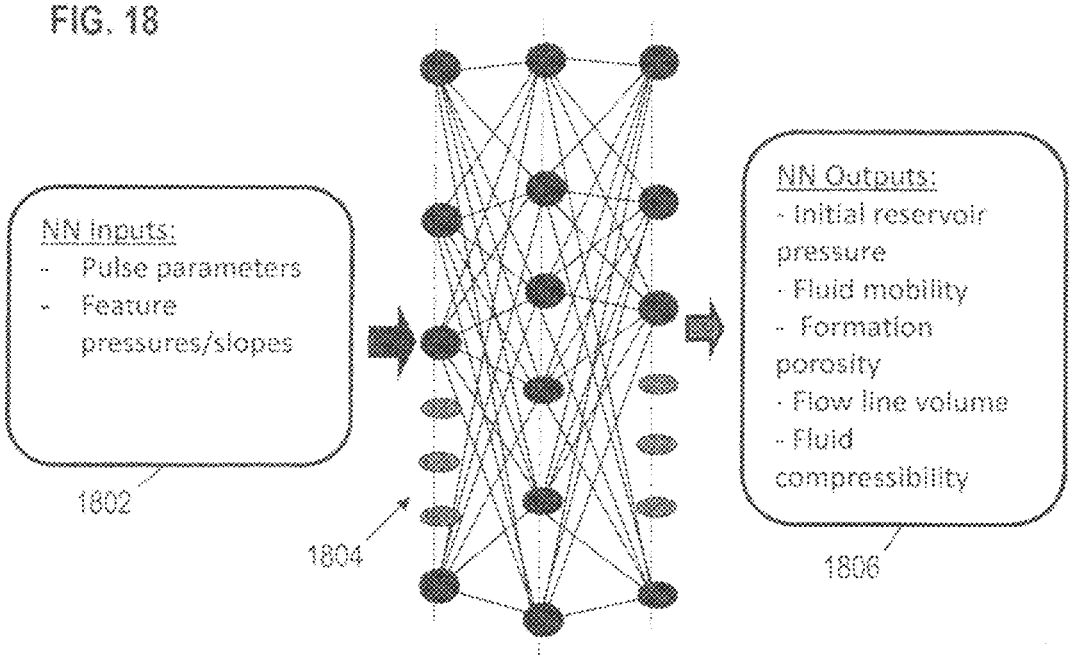
FIG. 18 shows prediction of reservoir parameters based on pulse pressure test results via neural network in accordance with principles disclosed herein.

In block 1706, inverse processing is applied to estimate reservoir parameters. The information derived from pulse pressure testing of the formation 136 may be processed through curve matching by using flow equations, learning/optimization algorithms, and directed neural net inversion. FIG. 18 shows neural network inversions of pulse pressure testing data. The neural network 1804 receives inputs 1802 including pulse parameters and formation pressures/slopes derived via pulse pressure testing. Based on the inputs 1802, the neural network 1804 produces outputs 1806. The neural network outputs 1806 may include formation parameters, such as initial reservoir pressure, fluid mobility, formation porosity, flow line volume, and fluid compressibility.

Various embodiments of apparatus and methods for adaptively pulse pressure testing a formation are described herein. In some embodiments, a method for formation testing, includes executing a first portion of the testing based on predetermined flow parameters; measuring a first set of formation pressure values produced by executing the first portion of the testing; selecting, from a plurality of simulated formation test results, a first set of simulated formation test results comprising one or more sets of simulated formation pressure values closest to the first set of formation pressure values; computing a first flow parameter based on the first set of simulated formation test results; and executing a second portion of the testing applying the first flow parameter. The first set of formation pressure values may include a slope of formation pressure change during a shut-in interval.

In some embodiments of a method, the selecting includes determining, for each of the plurality of simulated formation test results, a distance between the first set of formation pressure values and corresponding simulated formation pressure values of the simulated formation test results; and identifying two sets of simulated formation pressure values closest to the first set of formation pressures based on the distances. The computing includes computing the first flow parameter based on the two sets of simulated formation pressure values closest to the first set of formation pressures.

In some embodiments of a method, computing a weighted sum of flow ratios of the two sets of simulated formation pressure values; and computing the first flow parameter for use in the second portion of the test based on the weighted sum and the predetermined flow parameters.

In some embodiments of a method, the first set of formation pressure values includes a first portion drawdown pressure value; one of a first portion buildup pressure value and a first portion buildup pressure slope value; a first portion injection pressure value; and one of a first portion build down pressure value and a first portion build down pressure slope value. The first flow parameter includes a second portion drawdown flow rate.

In some embodiments, a method includes measuring a second set of formation pressure values produced by executing the second portion of the testing; selecting, from the plurality of simulated formation test results, a second set of simulated formation test results comprising formation pressure values closest to combined first and second sets of formation pressure values; computing a second flow parameter based on the second set of simulated formation test results; and executing a third portion of the testing applying the second flow parameter. The second set of formation pressure values may include a second portion drawdown pressure value; and one of a second portion build up pressure value and a second portion build up pressure slope value. The second flow parameter may include a third portion injection flow rate.

In some embodiments of a method, selecting the second set includes determining, for each of the plurality of simulated formation test results, a distance between the combined first and second sets of formation pressure values and corresponding pressure values of the simulated formation test result; and identifying two sets of simulated formation pressure values closest to the combined first and second sets of formation pressure values based on the distances. Computing the second flow parameter includes computing the second flow parameter based on the two sets of simulated formation pressure values closest to the combined first and second sets of formation pressure values.

Computing the second flow parameter may include computing a weighted sum of flow ratios of the two sets of simulated formation pressure values; and computing the second flow parameter for use in the third portion of the test based on the weighted sum and the first flow parameter.

In some embodiments, a method includes measuring a third set of formation pressure values produced by executing the third portion of the testing; selecting, from the plurality of simulated formation test results, a third set of simulated formation test results comprising formation pressure values closest to combined first, second, and third sets of formation pressure values; computing a third flow parameter based on the third set of simulated formation test results; and executing a fourth portion of the testing applying the third set of adaptive flow parameters.

In some embodiments, a method includes measuring a fourth set of formation pressure values produced by executing the fourth portion of the testing; selecting, from the plurality of simulated formation test results, a fourth set of simulated formation test results comprising formation pressure values closest to combined first, second, third, and fourth sets of formation pressure values; computing a fourth flow parameter based on the fourth set of simulated formation test results; and executing a fifth portion of the testing applying the fourth set of adaptive flow parameters.

In another embodiment, a system for pressure testing a formation includes a downhole tool configured to measure formation pressure; storage containing pressure parameters of a plurality of simulated formation pressure tests; and a formation pressure test controller coupled to the downhole tool and the storage. For each of a plurality of sequential pressure testing stages of a formation pressure test, the formation pressure test controller retrieves formation pressure measurements from the downhole tool; identifies one of the plurality of simulated formation pressure tests comprising pressure parameters closest to corresponding formation pressure values derived from the formation pressure measurements; and determines a flow rate to apply by the downhole tool in a next stage of the test based on the identified one of the plurality of simulated formation pressure tests.

In some embodiments of a system, for each of the plurality of sequential pressure testing stages of the formation pressure test, the formation pressure test controller determines, for each of the plurality of simulated formation tests, a distance between pressure parameters of the simulated formation test and the corresponding formation pressure values; identifies two of the simulated formation pressure tests comprising pressure parameters closest to the corresponding formation pressure values based on the determined distances; computes the flow rate based on the two simulated formation pressure tests; and applies the flow rate in the next stage of the test.

In some embodiments of a system, for each of the plurality of sequential pressure testing stages of the formation pressure test, the formation pressure test controller computes a weighted sum of flow ratio parameters of the two simulated formation pressure tests; and computes the flow rate based on the weighted sum and a flow rate applied in a previous stage of the pressure test.

In various embodiments of the a system, the simulated formation pressure tests include formation pressure tests simulated over a range of formation parameters that estimate parameters of the formation being pressure tested using the system.

In some embodiments of a system, a flow rate to apply in a second stage of the test may be a drawdown flow rate determined based on correspondence of formation pressure values derived from formation pressures measured in a first stage of the test to pressure parameters of the plurality of simulated formation pressure tests. A flow rate to apply in a third stage of the test may be an injection flow rate determined based on correspondence of formation pressure values derived from formation pressures measured in first and second stages of the test to pressure parameters of the plurality of simulated formation pressure tests. A flow rate to apply in a fourth stage of the test may be a drawdown flow rate determined based on correspondence of formation pressure values derived from formation pressures measured in first, second, and third stages of the test to pressure parameters of the plurality of simulated formation pressure tests. A flow rate to apply in a fifth stage of the test may be an injection flow rate determined based on correspondence of formation pressure values derived from formation pressures measured in first, second, third, and fourth stages of the test to pressure parameters of the plurality of simulated formation pressure tests.

The formation pressure measurements, applied by embodiments of a system, may include at least one of: a pressure value measured at a discrete point in time; a pressure value derived from a function fit to pressure values measured at discrete points in time; and a pressure value derived from a rate of pressure change over a given measurement time interval. The formation pressure values may include at least one of instantaneous formation pressure and slope of formation pressure over a predetermined interval.

Some embodiments of a system further include a neural network that computes formation parameters based on the formation pressure values.

In a further embodiment, a computer-readable storage medium is encoded with instructions that, when executed by a computer, cause the computer to retrieve formation pressure measurements from a downhole formation pressure measurement tool; identify one of a plurality of simulated formation pressure tests comprising pressure parameters closest to corresponding formation pressure values derived from the formation pressure measurements; and determine a flow rate to apply by the downhole tool in a next stage of the test based on the identified one of the plurality of simulated formation pressure tests. In some embodiments of a computer-readable medium, each of the formation pressure values includes one or more of a slope of formation pressure over a predetermined shut-in interval and a single formation pressure measurement.

In some embodiments, a computer-readable medium includes instructions that cause a computer to determine, for each of the plurality of simulated formation tests, a distance between pressure parameters of the simulated formation test and the corresponding formation pressure values; identify two of the simulated formation pressure tests comprising pressure parameters closest to the corresponding formation pressure measurements based on the determined distances; compute the flow rate based on the two simulated formation pressure tests; and apply the flow rate in the next stage of the test.

Embodiments of a computer-readable medium may include instructions that cause the computer to compute a weighted sum of flow ratio parameters of the two simulated formation pressure tests; and compute the flow rate based on the weighted sum and a flow rate applied in a previous stage of the pressure test.

Some embodiments of a computer-readable medium include instructions that cause the computer to a compute drawdown flow rates to apply as the flow rate in second and fourth stages of the test; wherein the drawdown flow rates for the second and fourth stages are computed based on correspondence of formation pressure values derived from formation pressures measured in all stages of the test preceding the computation of the drawdown flow rate to pressure parameters of the plurality of simulated formation pressure tests.

Some embodiments of a computer-readable medium include instructions that cause the computer to compute an injection flow rate to apply as the flow rate in third and fifth stages of the test; wherein the injection flow rates for the third and fifth stages are computed based on correspondence of formation pressure values derived from formation pressures measured in all stages of the test preceding the computation of the injection flow rate to pressure parameters of the plurality of simulated formation pressure tests.

In some embodiments of a computer-readable medium, each of the formation pressure values includes one or more of a slope of formation pressure over a predetermined shut-in interval and a single formation pressure measurement.

While specific embodiments have been illustrated and described, one skilled in the art can make modifications without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method for formation testing, comprising:

executing a first portion of the testing based on predetermined flow parameters;

measuring a first set of formation pressure values produced by executing the first portion of the testing;

selecting, from a plurality of simulated formation test results, a first set of simulated formation test results comprising one or more sets of simulated formation pressure values closest to the first set of formation pressure values;

computing a first flow parameter based on the first set of simulated formation test results; and executing a second portion of the testing applying the first flow parameter.

2. The method of claim 1, wherein the first set of formation pressure values comprise a slope of formation pressure change during a shut-in interval.

3. The method of claim 1, wherein the selecting comprises:

determining, for each of the plurality of simulated formation test results, a distance between the first set of formation pressure values and corresponding simulated formation pressure values of the simulated formation test results; and identifying, from the simulated formation test results, two sets of simulated formation pressure values closest to the first set of formation pressures values based on the distances;

wherein the computing comprises computing the first flow parameter based on the two sets of simulated formation pressure values closest to the first set of formation pressures values.

4. The method of claim 3, wherein computing the first flow parameter comprises:

computing a weighted sum of flow ratios of the two sets of simulated formation pressure values; and computing the first flow parameter for use in the second portion of the test based on the weighted sum and the predetermined flow parameters.

5. The method of claim 1, wherein:

the first set of formation pressure values comprises:

a first portion drawdown pressure value;

any one or a combination of a first portion buildup pressure value or a first portion buildup pressure slope value;

a first portion injection pressure value; and any one or a combination of a first portion build down pressure value or a first portion build down pressure slope value; and the first flow parameter comprises a second portion drawdown flow rate.

6. The method of claim 1, further comprising:

measuring a second set of formation pressure values produced by executing the second portion of the testing;

selecting, from the plurality of simulated formation test results, a second set of simulated formation test results comprising simulated formation pressure values closest to combined first and second sets of formation pressure values;

computing a second flow parameter based on the second set of simulated formation test results; and executing a third portion of the testing applying the second flow parameter.

7. The method of claim 6, wherein:

the second set of formation pressure values comprises:

a second portion drawdown pressure value; and any one or a combination of a second portion build up pressure value or a second portion build up pressure slope value; and the second flow parameter comprises a third portion injection flow rate.

8. The method of claim 6, wherein:

the selecting the second set comprises:

determining, for each of the plurality of simulated formation test results, a distance between the combined first and second sets of formation pressure values and corresponding pressure values of the simulated formation test result; and identifying, from the simulated formation test results, two sets of simulated formation pressure values closest to the combined first and second sets of formation pressure values based on the distances; and computing the second flow parameter comprises computing the second flow parameter based on the two sets of simulated formation pressure values closest to the combined first and second sets of formation pressure values.

9. The method of claim 8, wherein computing the second flow parameter comprises:

computing a weighted sum of flow ratios of the two sets of simulated formation pressure values; and computing the second flow parameter for use in the third portion of the test based on the weighted sum and the first flow parameter.

10. The method of claim 6, further comprising:

measuring a third set of formation pressure values produced by executing the third portion of the testing;

selecting, from the plurality of simulated formation test results, a third set of simulated formation test results comprising simulated formation pressure values closest to combined first, second, and third sets of formation pressure values;

computing a third flow parameter based on the third set of simulated formation test results; and executing a fourth portion of the testing applying the third set of adaptive flow parameters.

11. The method of claim 10, further comprising:

measuring a fourth set of formation pressure values produced by executing the fourth portion of the testing;

selecting, from the plurality of simulated formation test results, a fourth set of simulated formation test results comprising simulated formation pressure values closest to combined first, second, third, and fourth sets of formation pressure values;

computing a fourth flow parameter based on the fourth set of simulated formation test results; and executing a fifth portion of the testing applying the fourth set of adaptive flow parameters.

12. A system for pressure testing a formation, comprising:

a downhole tool configured to measure formation pressure;

storage containing simulated pressure parameters of a plurality of simulated formation pressure tests; and a formation pressure test controller coupled to the downhole tool and the storage, wherein for each of a plurality of sequential pressure testing stages of a formation pressure test, the formation pressure test controller:

retrieves formation pressure measurements from the downhole tool;

identifies one of the plurality of simulated formation pressure tests comprising simulated pressure parameters closest to corresponding formation pressure values derived from the formation pressure measurements; and determines a flow rate to apply by the downhole tool in a next stage of the test based on the identified one of the plurality of simulated formation pressure tests.

13. The system of claim 12, wherein for each of the plurality of sequential pressure testing stages of the formation pressure test, the formation pressure test controller:

determines, for each of the plurality of simulated formation tests, a distance between pressure parameters of the simulated formation test and the corresponding formation pressure values;

identifies two of the simulated formation pressure tests comprising simulated pressure parameters closest to the corresponding formation pressure values based on the determined distances;

computes the flow rate based on the two simulated formation pressure tests; and applies the flow rate in the next stage of the test.

14. The system of claim 12, wherein for each of the plurality of sequential pressure testing stages of the formation pressure test, the formation pressure test controller:

computes a weighted sum of flow ratio parameters of the two simulated formation pressure tests; and computes the flow rate based on the weighted sum and a flow rate applied in a previous stage of the pressure test.

15. The system of claim 12, where the simulated formation pressure tests comprise formation pressure tests simulated over a range of formation parameters that estimate parameters of the formation being pressure tested using the system.

16. The system of claim 12, wherein a flow rate to apply in a second stage of the test is a drawdown flow rate determined based on correspondence of formation pressure values derived from formation pressures measured in a first stage of the test to pressure parameters of the plurality of simulated formation pressure tests.

17. The system of claim 12, wherein a flow rate to apply in a third stage of the test is an injection flow rate determined based on correspondence of formation pressure values derived from formation pressures measured in first and second stages of the test to pressure parameters of the plurality of simulated formation pressure tests.

18. The system of claim 12, wherein a flow rate to apply in a fourth stage of the test is a drawdown flow rate determined based on correspondence of formation pressure values derived from formation pressures measured in first, second, and third stages of the test to pressure parameters of the plurality of simulated formation pressure tests.

19. The system of claim 12, wherein a flow rate to apply in a fifth stage of the test is an injection flow rate determined based on correspondence of formation pressure values derived from formation pressures measured in first, second, third, and fourth stages of the test to pressure parameters of the plurality of simulated formation pressure tests.

20. The system of claim 12, wherein the formation pressure measurements comprise at least one of:

a pressure value measured at a discrete point in time;

a pressure value derived from a function fit to pressure values measured at discrete points in time; and a pressure value derived from a rate of pressure change over a given measurement time interval.

21. The system of claim 12, wherein the formation pressure values comprise at least one of instantaneous formation pressure and slope of formation pressure over a predetermined interval.

22. The system of claim 12, further comprising a neural network configured to computes, formation parameters based on the formation pressure values.

23. A computer-readable storage medium encoded with instructions that, when executed by a computer, cause the computer to:

retrieve formation pressure measurements from a downhole formation pressure measurement tool;

identify one of a plurality of simulated formation pressure tests comprising simulated pressure parameters closest to corresponding formation pressure values derived from the formation pressure measurements; and determine a flow rate to apply by the downhole tool in a next stage of the test based on the identified one of the plurality of simulated formation pressure tests.

24. The computer-readable medium of claim 23, further comprising instructions that cause the computer to:

determine, for each of the plurality of simulated formation tests, a distance between pressure parameters of the simulated formation test and the corresponding formation pressure values;

identify two of the simulated formation pressure tests comprising simulated pressure parameters closest to the corresponding formation pressure measurements based on the determined distances;

compute the flow rate based on the two simulated formation pressure tests; and apply the flow rate in the next stage of the test.

25. The computer-readable medium of claim 24, further comprising instructions that cause the computer to:

compute a weighted sum of flow ratio parameters of the two simulated formation pressure tests; and compute the flow rate based on the weighted sum and a flow rate applied in a previous stage of the pressure test.

26. The computer-readable medium of claim 23, further comprising instructions that cause the computer to a compute drawdown flow rates to apply as the flow rate in second and fourth stages of the test; wherein the drawdown flow rates for the second and fourth stages are computed based on correspondence of formation pressure values derived from formation pressures measured in all stages of the test preceding the computation of the drawdown flow rate to pressure parameters of the plurality of simulated formation pressure tests.

27. The computer-readable medium of claim 23, further comprising instructions that cause the computer to compute an injection flow rate to apply as the flow rate in third and fifth stages of the test; wherein the injection flow rates for the third and fifth stages are computed based on correspondence of formation pressure values derived from formation pressures measured in all stages of the test preceding the computation of the injection flow rate to pressure parameters of the plurality of simulated formation pressure tests.

28. The computer-readable medium of claim 23 wherein each of the formation pressure values comprise one or more of a slope of formation pressure over a predetermined shut-in interval and a single formation pressure measurement.

* * * * *